United States Patent [19]

Nilssen

[11] Patent Number: 4,896,078

[45] Date of Patent: Jan. 23, 1990

[54] DISTRIBUTED BALLASTING SYSTEM FOR SUN TANNING APPARATUS

[76] Inventor: Ole K. Nilssen, Caesar Dr., Rte. 5, Barrington, Ill. 60010

[21] Appl. No.: 730,599

[22] Filed: May 6, 1985

[51] Int. Cl.[4] ..... H05B 41/29

[52] U.S. Cl. ..... 315/312; 315/97; 315/255; 315/324; 315/DIG. 5

[58] Field of Search ..... 315/312, 209 R, 174, 315/175, 317, 318, 319, 324, DIG. 5, 97, 98, 254, 255, 257; 363/50, 172, 159; 339/57

[56] References Cited

U.S. PATENT DOCUMENTS

| | | | |
|---|---|---|---|
| 2,965,804 | 12/1960 | Roesel, Jr. et al. | 315/324 |
| 3,233,146 | 2/1966 | Vacha | 315/97 |
| 3,323,006 | 5/1967 | Gould | 315/98 X |
| 3,328,721 | 6/1967 | Hehenkamp et al. | 315/DIG. 5 |
| 3,359,414 | 12/1967 | Ege | 339/57 |
| 3,971,967 | 7/1976 | Hawkins | 315/98 X |
| 4,207,498 | 6/1980 | Spira et al. | 315/224 |
| 4,277,726 | 7/1981 | Burke | 315/101 |
| 4,369,490 | 1/1983 | Blum | 363/48 |
| 4,477,748 | 10/1984 | Grubbs | 315/306 |
| 4,499,403 | 2/1985 | Leppelmeier et al. | 313/487 |
| 4,502,107 | 2/1985 | Nilssen | 363/133 |
| 4,508,996 | 4/1985 | Clegg et al. | 315/250 |
| 4,560,908 | 12/1985 | Stupp et al. | 315/283 |

*Primary Examiner*—Eugene R. LaRoche

[57] ABSTRACT

A ballasting system for powering an array of multiple parallel-oriented fluorescent lamps in a sun tanning apparatus comprises and an electronic frequency converter adapted to convert ordinary 60 Hz power line voltage into a 350 Volt/30 Hz sinusoidal voltage provided between a pair of bus conductors and suitable for directly powering each fluorescent lamp by way of a simple capacitive or inductive current-limiting reactance means. The fluorescent lamp cathodes are heated by way of individual transformers, with one transformer for each pair of lamp cathodes. Only two pairs of distribution conductors are required for powering the complete array of mutually parallel-disposed fluorescent lamp pairs regardless of the number of lamps involved, with one pair running along the one side of the array, and the other pair running along the other side of the array. Of each pair of fluorescent lamps, one lamp is powered by way of an inductive reactance means and one lamp is powered by way of a capacitive reactance means. That way, as long as each of the two lamps operates at approximately the same power level, the total net load represented by each pair of lamps will be substantially resistive.

10 Claims, 3 Drawing Sheets

DISTRIBUTED BALLASTING SYSTEM FOR SUN TANNING APPARATUS

BACKGROUND OF THE INVENTION

1. Field of Invention

The present invention relates to a distributed ballasting system for sun tanning and other skin treatment apparatus, particularly of the kind using a plurality of fluorescent lamps.

2. Prior Art

An ordinary sun tanning bed or booth typically comprises between 20 and 40 parallel-oriented fluorescent lamps, with each lamp being 72" long and requiring about 100 Watt of power input for effective operation. These lamps are powered by way of a plurality of individual ballasts, with each ballast powering one or two lamps.

The fluorescent lamps used are of the so-called rapid-start type; which implies that each lamp requires four supply wires for proper operation. As an overall result, the number of wires required for powering 20-to-40 fluorescent lamps gets to be very unwiedly.

SUMMARY OF THE INVENTION

Brief Description

In its preferred embodiment, subject invention constitutes a ballasting system for an array of multiple parallel-oriented fluorescent lamps in a sun tanning apparatus and comprises an electronic frequency converter adapted to convert ordinary 60 Hz power line voltage into a 350 Volt/30 kHz sinusoidal voltage provided between a pair of bus conductors and suitable for directly powering each fluorescent lamp by way of simple capacitive or inductive current-limiting reactance means.

The fluorescent lamp cathodes are heated by way of individual transformers, with one transformer for each pair of lamp cathodes. Only two pairs of distribution conductors are required for powering the complete array of parallel-oriented fluorescent lamps regardless of the number of lamps involved, with one pair running along the one side of the array, and with the other pair running along the other side of the array.

For each pair of fluorescent lamps, one lamp is powered by way of an inductive reactance means and one lamp is powered by way of a capacitive reactance means. That way, as long as each of the two lamps operates at approximately the same power level, the total net load represented by each pair of lamps will be substantially resistive.

DESCRIPTION OF THE PREFERRED EMBODIMENT

Details of Construction

Figure 1:
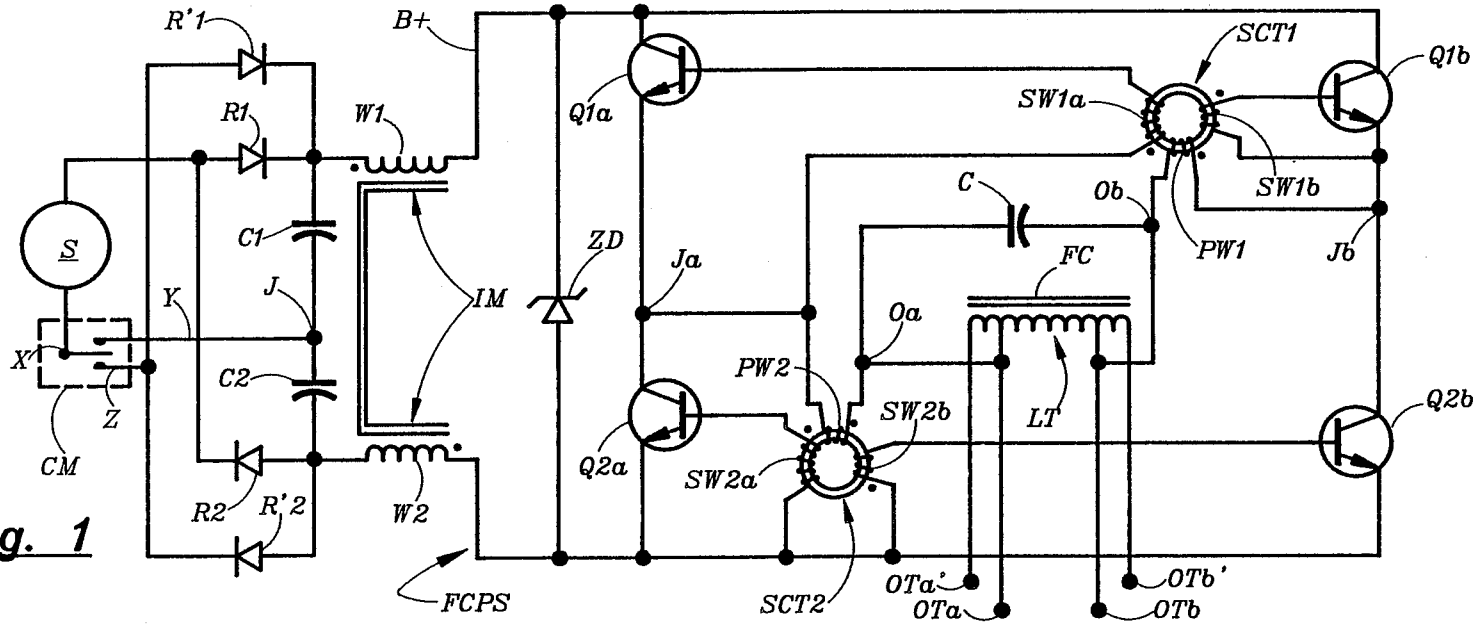
FIG. 1 provides a schematic illustration of the frequency converter means used in the preferred embodiment of the invention.

FIG. 1 shows an AC power supply S, one terminal of which is connected to a point X. This point X is connected by way of a connection means CM to conductor Y, which is connected to a junction J between two energy-storing capacitors C1 and C2.

The other terminal of power supply S is connected to the anode of a rectifier R1 and to the cathode of a rectifier R2. Rectifier R1 has its cathode connected to one terminal of C1 —the other terminal of C1 being connected to junction J. Rectifier R2 has its anode connected to one terminal of C2—the other terminal of C2 being connected to junction J.

Connected with connector means CM is a conductor Z, which is connected to the anode of a rectifier R'1 and to the cathode of a rectifier R'2. Rectifier R'1 has its cathode connected to the cathode of rectifier R1; and rectifier R'2 has its anode connected to the anode of rectifier R2.

An inductor means IM has two equal but separate windings W1 and W2. Winding W1 is connected between the cathode of rectifier R1 and a bus conductor B+; which bus conductor is connected to the collectors of two transistors Q1*a* and Q1*b*. Winding W2 is connected between the anode of R2 and a bus conductor B−; which bus conductor is connected to the emitters of two transistors Q2*a* and Q2*b*.

A Zener diode ZD is connected between the B+ bus and the B− bus.

Transistor Q1*a* is connected with its emitter to a junction Ja, as is also the collector of transistor Q2*a*. Transistor Q1*b* is connected with its emitter to a junction Jb, as is also the collector of transistor Q2*b*.

An inductor-transformer combination LT is wound on a ferrite core FC and is connected between inverter output terminals Oa and Ob. Connected in parallel with LT is a capacitor C. Inverter output terminal Oa is connected with overall output terminal OTa; inverter output terminal Ob is connected with overall output terminal OTb.

Inductor-transformer LT has two auxiliary output terminals connected with output terminals OTa' and OTb'.

Primary winding PW1 of saturable current-transformer SCT1 is connected between junction Jb and output terminal Ob. Primary winding PW2 of saturable current-transformer SCT2 is connected between junction Ja and output terminal Oa.

One secondary winding SW1*a* of transformer SCT1 is connected between the base and the emitter of transistor Q1*a*; another secondary winding SW1*b* of transformer SCT1 is connected between the base and the emitter of transistor Q1*b*.

One secondary winding SW2*a* of transformer SCT2 is connected between the base and the emitter of transistor Q2*a*; another secondary winding SW2*b* of transformer SCT2 is connected between the base and the emitter of transistor Q2*b*.

The complete assembly connected with AC power supply S and having two pairs of output terminals, namely a first pair OTa and OTa', and a second pair OTb and OTb', is referred to as frequency-converting power supply FCPS.

Figure 2:
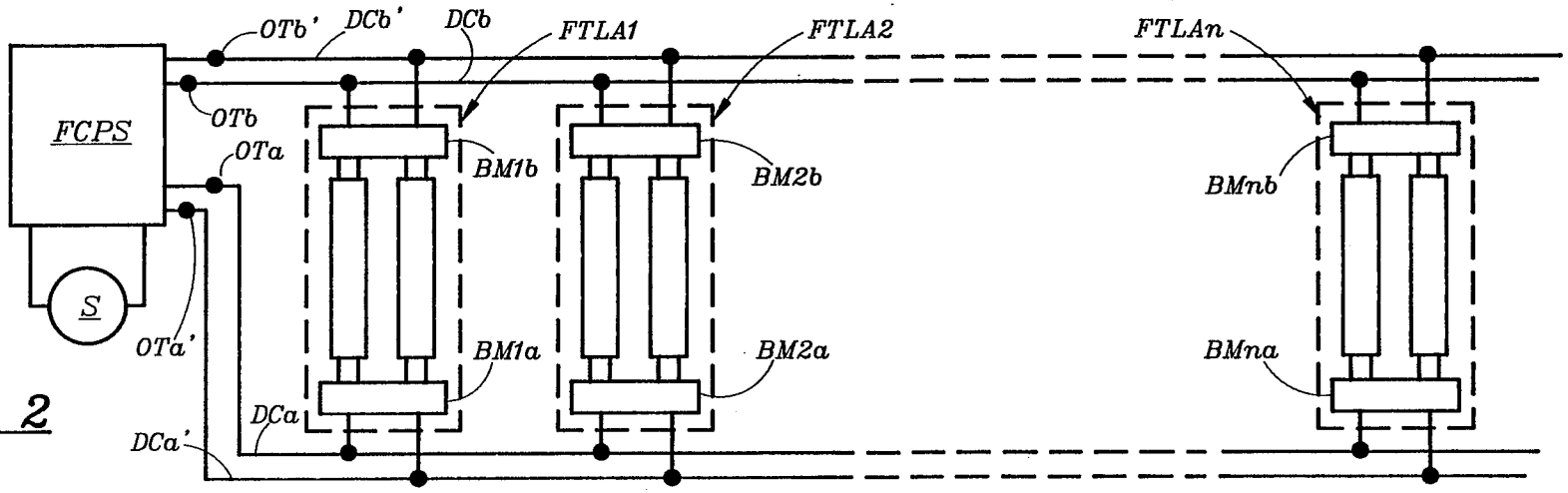
FIG. 2 diagrammatically describes the overall operating system in its preferred embodiment, including the frequency converter means, two pairs of distribution conductors coming therefrom, and multiple pairs of fluorescent lamps connected between these pairs of distribution conductors by way of a high-frequency ballast means for each pair of lamps.

FIG. 2 shows the two pairs of output terminals from power supply FCPS connected, by way of distribution conductors DCa, DCa', DCb and DCb', with an array of n fluorescent tanning lamp assemblies: FTLA1, FTLA2 --- FTLAn. Each fluorescent tanning lamp assembly comprises an associated ballast means: BM1*a* and BM1*b*, BM2*a* and BM2*b* --- BMna and BMnb.

Figure 3:
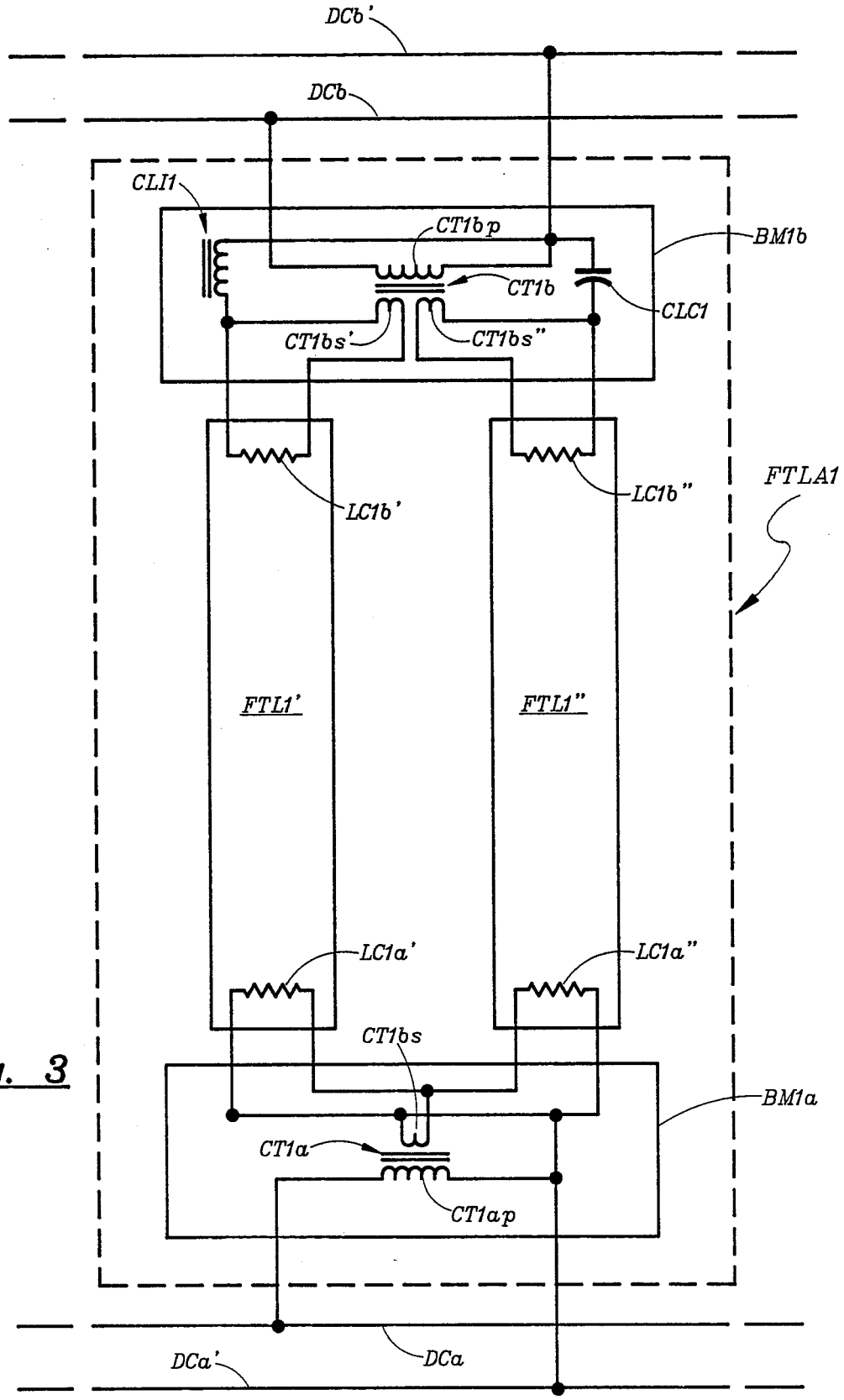
FIG. 3 provides schematic details of the high frequency ballast means.

FIG. 3 shows details of fluorescent tanning lamp assembly FTLA1.

A cathode transformer CT1*b* has a primary winding CT1*bp* connected across distribution conductors DCb and DCb'; and it has two secondary winding CT1*bs'* and CT1*bs''* connected with lamp cathodes LC1*b'* and LC1*b''* of fluorescent tanning lamps FTL1' and FTL1'', respectively.

A current-limiting inductor CLI1 is connected between distribution conductor DCb' and one of the terminals of lamp cathode LC1*b'*. A current-limiting capacitor CLC1 is connected between distribution conductor DCb' and one of the terminals of lamp cathode LC1*b''*.

A cathode transformer CT1*a* has a primary winding CT1*ap* connected across distribution conductors DCa and DCa'; and it has a single secondary winding CT1*bs* connected with parallel-connected lamp cathodes LC1*a'* and LC1*a''* of fluorescent tanning lamps FTL1' and FIL1'', respectively. One of the terminals of each of the parallel-connected cathodes is connected with distribution connector DCa'.

Description of Operation

The operation of the frequency-converting power supply of FIG. 1 may be explained as follows.

AC power supply S provides 120 Volt/60 Hz voltage to the voltage-doubling and rectifying/filtering circuit consisting of R1, R2, C1 and C2. A substantially constant DC voltage of about 320 Volt magnitude then results at the output of this circuit, with the positive side of this DC voltage being provided by way of W1 to the B+ bus, and the negative side being provided by way of W2 to the B− bus.

(If this 120 Volt/60 Hz voltage were to be a 240 Volt/60 Hz voltage instead, the same 320 Volt constant-magnitude DC voltage would result, provided connector means CM is changed so as to have point X make contact with conductor Z instead of with conductor Y. Thus, the frequency-converting power supply FCPS of FIG. 1 may equally well be powered from 120 Volt/60 Hz as from 240 Volt/60 Hz—with essentially the same overall operating results.)

This 320 Volt substantially constant-magnitude DC voltage is applied by way of inductor means IM and its two windings W1 and W2, poled as indicated, to the B+ bus and the B− bus, and thereby to the DC power input terminals of the full-bridge inverter circuit comprising transistors Q1*a*, Q1*b*, Q2*a* and Q2*b*.

This inverter circuit is made to self-oscillate by way of positive current feedback provided by saturable current-transformers SCT1 and SCT2, poled as indicated. Thus, the magnitude of the current provided to any given transistor's base-emitter junction is proportional to the magnitude of the current flowing between output terminals Oa and Ob.

The frequency of inverter oscillation is determined by a combination of the saturation characteristics of the saturable current-transformers and the natural resonance frequency of the parallel combination of LT and C—modified by any tuning effects caused by the reactance of any load connected thereacross.

The saturation characteristics of the saturable current-transformers are substantially identical to one another and so chosen that, when the load connected across output terminals OTa, OTa', OTb and OTb' has no significant reactive component, the waveform of the output voltage provided between any two of the four output terminals is essentially sinusoidal in waveshape.

With the particular circuit components and values chosen, the frequency of this substantially sinusoidal output voltage is approximately 30 kHz.

In combination, the two separate but equal windings W1 and W2 of inductor means IM provide for a total inductance that is large enough so that the current flowing through the two windings and into the inverter remains substantially constant during a complete time-period of one cycle of the inverter's oscillation. Thus, by way of the inverter's commutating action, the inverter's tuned tank circuit (that is, the parallel-combination of LT and C) represents a parallel-resonant circuit that is fed from a substantially constant-magnitude square-wave AC current source.

Of course, over a period of several cycles of the inverter's oscillation, the magnitude of this constant-magnitude squarewave AC current may change—depending on load conditions.

With a DC voltage of about 320 Volt applied to the inverter, the magnitude of the 30 kHz output voltage provided from the inverter, which output voltage is provided between output terminals OTa and OTb, is approximately 350 Volt RMS. The magnitude of the 30 kHz voltage between output terminals OTa and OTa' is approximately 25 Volt RMS, and that between output terminals OTb and OTb' is likewise approximately 25 Volt RMS. Thus, the magnitude of the 30 kHz voltage provided between output terminals OTa' and OTb' is about 400 Volt RMS.

The operation of the overall operating system may best be understood by considering FIG. 2 in conjunction with FIG. 3. The several fluorescent tanning lamp assemblies are connected between the two pairs of distribution conductors, namely DCa & DCa' and DCb & DCb', and powered by the 350–400 Volt/30 kHz substantially sinusoidal constant-magnitude voltage provided thereat. Each of the lamps in these lamp assemblies is a 72" T-12 rapid-start high-output fluorescent tanning lamp; which lamp requires an operating voltage of about 125 Volt RMS, and a starting voltage of about 350 Volt RMS. To provide full light output, each lamp requires a lamp current of about 800–1000 milli-Ampere.

In FIG. 3, the 25 Volt/30 kHz voltage provided between distribution conductors DCa and DCa' is used for providing low voltage heating power for lamp cathodes LC1*a'* and LC1*a''* by way of voltage step-down transformer CT1*a*. Similarly, the 25 Volt/30 kHz voltage between DCb and DCb' is used to provide low voltage heating power for lamp cathodes LC1*b'* and LC1*b''* by way of voltage step-down transformer CT1*b*.

With particular reference to FIG. 3, it is seen that the two fluorescent tanning lamps are each connected between the DCa' and the DCb' distribution conductors; with the one lamp (FTL1') having an inductor (CLI1) as its current-limiting or ballasting means, and the other lamp (FTL1'') having a capacitor (CLC1) as its current-limiting or ballasting means. Having one lamp ballasted with an inductor and its associated lamp ballasted with a capacitor gives rise to the important result that the net overall load presented to the distribution conductors by the complete lamp assembly (FTLA1) is substantially resistive, at least as long as the lamps are more-or-less identical with one another and as long as each lamp is operated at about the same power level.

With the load presented to the frequency-converting power supply (FCPS) being substantially resistive, the line losses associated with distributing power to the plurality of fluorescent lamps are minimized, as is also the associated electro-magnetic radiation. Moreover, the requirements in respect to the energy-storing capabilities of the inductor LT and tank capacitor C of the inverter output circuit has been greatly reduced, as has also the inverter frequency variations resulting from loading effects.

The magnitude of the Zener voltage of Zener diode ZD is chosen such as to be somewhat higher than the maximum magnitude of the peak voltage of the sinusoidal half-waves of voltage present across the inverter's output terminals Oa and Ob. That way, the Zener diode will not interfere with normal operation of the inverter; yet, it will prevent the magnitude of the peak voltages of the sinusoidal half-waves from substantially exceeding the normally occurring maximum magnitudes. Without the Zener diode, for various transient reasons (such as due to the sudden removal of a load) the magnitude of the peak voltages of the sinusoidal half-waves would occasionally become substantially larger than the normally occurring maximum magnitudes; and that would either cause transistor destruction, or it would necessitate the use of very special transistors of exceptionally high voltage capabilities.

Comments (a) Inductor means IM may consist of two entirely independent inductors—with one inductor located in each leg of the power supply; or, it is even acceptable in many circumstances that inductor IM be but a single inductor in just one leg of the power supply.

(b) The inverter of FIG. 1 must be triggered into oscillation. This triggering may be accomplished by way of providing a special trigger winding on each of the feedback current-transformers, and then to discharge a capacitor through these trigger windings. This may be done automatically with an arrangement consisting of a capacitor-resistor combination connected between B+ and B−, and a Diac for discharging the capacitor through the trigger windings. More details in respect to triggering a bridge inverter into oscillation can be found in Nilssen U.S. Pat. No. 4,502,107.

(c) There is no basic need for using saturable current transformers in the feedback circuit in the self-oscillating inverter of FIG. 1. Rather, positive feedback can be achieved by way of using one or more secondary windings on the main tank inductor LT. More details in respect to providing feedback in this fashion can be found in Burke U.S. Pat. No. 4,277,726.

(d) There is a significant advantage in using a full bridge inverter, as in FIG. 1 hereof, as compared with regular push-pull inverters, as more commonly used in connection with parallel-resonant inverter output circuits. This significant advantage relates to the required voltage-handling capabilities of the inverter transistors. In a bridge inverter, these voltage-handling capabilities need only be half as high as with ordinary push-pull inverters. Thus, if an ordinary current-fed push-pull inverter loaded with a parallel-tuned resonant circuit were to be powered from a 320 Volt DC source, the individual transistors would be exposed to peak voltages as high as 1060 Volt or so; whereas with the bridge inverter of FIG. 1, the transistors would be exposed to peak voltages no higher than about 530 Volt.

(e) The voltage between distribution conductors DCa and DCa′ could have been chosen to be about 3.6 Volt RMS; in which case cathode transformer CT1*a* would be obviated. However, for situations requiring the operation of a relatively large number of fluorescent lamps, the resulting voltage drop due to the relatively high-magnitude resulting cathode current would be undesirable.

(f) Inductor/transformer LT is wound on a ferrite core with a small air gap. Thus, any windings wound on top of or next to the main winding between Oa and Ob will couple tightly therewith.

(g) It is noted that the average absolute magnitude of the AC voltage appearing between inverter output terminals Oa and Ob must be substantially equal to the magnitude of the DC voltage present between the B+ bus and the B− bus.

Or, stated differently, in the circuit of FIG. 1, if the inverter's AC output voltage as provided between terminals Oa and Ob were to be rectified in a full-wave rectifier, the average magnitude of the DC voltage obtained from this full-wave rectifier would have to be substantially equal to the magnitude of the DC voltage existing between the B+ bus and the B− bus.

This relationship would have to exist substantially regardless of the nature of the load connected between the inverter's output terminals.

(h) It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. Distributed ballasting system particularly suitable for a sun tanning apparatus and operable to power a plurality of fluorescent lamps, each fluorescent lamp having a first and a second cathode, the fluorescent lamps being positioned substantially in parallel with one another and in such manner that all the first cathodes are aligned along a first path and all the second cathodes are aligned along a second path, said ballasting system comprising:

rectifier and filter means adapted to connect with an ordinary electric utility power line and, when so connected, operative to provide a substantially non-current-limited and constant-magnitude DC voltage at a first set of DC terminals;

inductor means connected between said first set of DC terminals and a second set of DC terminals, thereby providing at said second set of DC terminals a unidirectional voltage from a substantially constant-magnitude source having an inductive internal impedance;

inverter means connected with said second set of DC terminals and operable to provide at a set of central output terminals a substantially non-current-limited AC voltage having an essentially sinusoidal waveshape and a frequency significantly higher than that of the voltage on said power line, said inverter means having an L-C parallel-circuit connected in circuit with said central output terminals, said L-C parallel-circuit being resonant at or near the frequency of said AC voltage;

a first pair of distribution conductors: (i) connected with said central output terminals, (ii) disposed substantially along said first path, and (iii) connected with each of said first cathodes by way of current-limiting means; and a second pair of distribution conductors: (i) connected with said central output terminals, (ii) disposed substantially along said second path, and (iii) connected with each of said second cathodes;

whereby said plurality of fluorescent lamps is powered from the AC voltage provided from said set of central output terminals by way of said two pairs of distribution conductors.

2. The ballasting means of claim 1 wherein said first path or said second path is so constituted geometrically as to lie in a flat plane.

3. The ballasting means of claim 1 wherein the magnitude of the voltage present between said first pair of distribution conductors is substantially different than the magnitude of the voltage existing between one of said first pair of distribution conductors and one of said second pair of distribution conductors.

4. The ballasting means of claim 1 wherein the magnitude of the voltage present between one of said first pair of distribution conductors and one of said second pair of distribution conductors is adequate to ignite and operate said fluorescent lamps.

5. An operating system for a sun tanning apparatus, comprising:

rectifier and filter means adapted to connect with an ordinary electric utility power line and, when so connected, operative to provide a substantially non-current-limited and constant-magnitude DC voltage at a first set of DC terminals;

inductor means connected between said first set of DC terminals and a second set of DC terminals, thereby providing at said second set of DC terminals a unidirectional voltage from a substantially constant-magnitude source having an inductive internal impedance;

inverter means connected with said second set of DC terminals and operable to provide at a set of central output terminals a substantially non-current-limited AC voltage having an essentially sinusoidal waveshape and a frequency significantly higher than that of the voltage on said power line, said inverter means having an L-C parallel-circuit connected in circuit with said central output terminals, said L-C parallel-circuit being resonant at or near the frequency of said AC voltage;

a plurality of fluorescent lamp assemblies, each lamp assembly having: (i) an elongated shape, (ii) a first set of input connect means located at one end of said elongated shape, (iii) a second set of input connect means located at the other end of said elongated shape, (iv) a major axis defined as a line drawn between the two sets of input connect means, (v) a fluorescent lamp having a first and a second thermionic cathode, (vi) cathode heating means connected in circuit between said input connect means and said cathodes, and conditionally operable to provide low-voltage heating power thereto, and (vii) current-limiting means connected in circuit between said connect means and said cathodes, and conditionally operable to provide current-limited AC voltage for starting and operating the fluorescent lamp; said lamp assemblies being so disposed as to have: (i) their major axes aligned substantially in parallel with one another, (ii) their first connect means disposed along a first path, and (iii) their second connect means disposed along a second path; and distribution means having a first and a second pair of distribution conductors connected with said central output terminals, said first pair of distribution conductors being connected with the first connect means of each lamp assembly, said second pair of distribution conductors being connected with the second connect means of each lamp assembly;

whereby said AC voltage is distributed to each lamp assembly, thereby causing said low-voltage heating power and said current-limited AC voltage to be provided.

6. The operating system of claim 5 wherein said plurality of fluorescent lamp assemblies in combination represents a substantially resistive load to said central output terminals.

7. An arrangement comprising:

a power supply operative to provide electrical power from a set of output terminals;

plural gas discharge lamps; each gas discharge lamp having a first set of lamp terminals at a first end and a second set of lamp terminals at a second end; the lamps being so disposed that each of the first ends is located along a first path and each of the second ends is located along a second path;

a pair of first distribution conductors connected with the output terminals and disposed substantially along the first path; there existing a voltage between the two first distribution conductors;

a pair of second distribution conductors connected with the output terminals and disposed substantially along the second path; there existing a voltage between the two second distribution conductors; and for each gas discharge lamp: (i) a first connection means operative to connect between the first distribution conductors and the first set of lamp terminals; and (ii) a second connection means operative to connect between the second distribution conductors and the second set of lamp terminals.

8. The arrangement of claim 7 wherein said first connection means includes transformer means.

9. The arrangement of claim 8 wherein a substantially sinusoidal voltage exists between the pair of first distribution conductors and the pair of second distribution conductors.

10. The arrangement of claim 8 wherein the power supply comprises frequency converter means connected with an ordinary electric utility power line.

* * * * *